US007631482B2

(12) United States Patent
Drummond et al.

(10) Patent No.: US 7,631,482 B2
(45) Date of Patent: Dec. 15, 2009

(54) MULTIPLE PHASE POWER SUPPLY FOR ROCKET ENGINES

(75) Inventors: Geoffrey N. Drummond, Fort Collins, CO (US); Jeffery M. Monheiser, Monroe, WA (US)

(73) Assignee: Aerojet-General Corporation, Redmond, WA (US)

( * ) Notice: Subject to any disclaimer, the term of this patent is extended or adjusted under 35 U.S.C. 154(b) by 1024 days.

(21) Appl. No.: 11/123,374

(22) Filed: May 6, 2005

(65) Prior Publication Data

US 2009/0255231 A1 Oct. 15, 2009

Related U.S. Application Data

(60) Provisional application No. 60/608,946, filed on Aug. 30, 2004.

(51) Int. Cl.
*F03H 1/00* (2006.01)
*H05H 1/00* (2006.01)

(52) U.S. Cl. ..... 60/202; 313/360.1; 315/111.61

(58) Field of Classification Search ..... 60/202, 60/203.1; 313/360.1; 315/111.61
See application file for complete search history.

(56) References Cited

U.S. PATENT DOCUMENTS 2,688,087 A * 8/1954 Robinson ..... 313/361.1
3,225,236 A * 12/1965 Meyer ..... 60/202
3,317,846 A * 5/1967 Dryden ..... 60/202
3,485,987 A * 12/1969 Porterfield ..... 219/69.18
5,548,953 A * 8/1996 Hedges et al. ..... 60/202
5,924,277 A * 7/1999 Beattie et al. ..... 60/202
6,118,678 A * 9/2000 Limpaecher et al. ..... 363/60
6,948,305 B2 * 9/2005 Beattie et al. ..... 60/202
2006/0208707 A1 * 9/2006 Jacobson et al. ..... 320/166

* cited by examiner

*Primary Examiner*—Ted Kim
(74) *Attorney, Agent, or Firm*—Christensen O'Connor Johnson Kindness PLLC

(57) ABSTRACT

Conventional power supplies that actify the grids of electric rockets use an output capacitor to smooth the output DC voltage signal. Large capacitors tend to store a great amount of energy. Arcing acts to transfer this energy to create a well or pit on an accelerator grid of the electric rockets that may eventually cause repeating arcing or perforation on the accelerator grid. Various embodiments of the present invention eliminate or reduce the need to use an output capacitor. Additionally, various embodiments of the present invention use multiple phases of an input signal into the power supply to cause the output DC voltage signal to be substantially smooth.

5 Claims, 11 Drawing Sheets

MULTIPLE PHASE POWER SUPPLY FOR ROCKET ENGINES

CROSS-REFERENCE TO RELATED APPLICATION

This application claims the benefit of U.S. Provisional Application No. 60/608,946 filed Aug. 30, 2004, which is specifically incorporated herein by reference.

FIELD OF THE INVENTION

The present invention relates generally to propulsion systems, and more particularly, to a power supply for accelerating and expelling charged particles for propelling plasma rockets.

BACKGROUND OF THE INVENTION

A rocket ship 102 is a rocket-propelled spaceship, which is a vehicle used for space travel or space missions 104. Today, the U.S. space program is limited to short trips to planets that are within proximity to Earth, such as Mars. The National Aeronautics and Space Administration has expressed a desire to accomplish deeper space missions, such as to Jupiter and beyond. As a result, the time that the rocket ship 102 would have to spend in space would have to grow correspondingly longer. Rockets that are used for short trips are inadequate to last for the duration of deep space missions. For these missions, rockets may have to last up to 5-10 years or longer. That is an order of magnitude longer than most rockets that are designed for today's usage. Various efforts are underway to identify life-limiting factors of rockets. One of the life limiting factors is the erosion of the exhaust nozzles (grids) of rockets. This and other problems are more fully illustrated below.

A rocket 100 is a jet engine that operates on the same principle as a piece of fireworks that a child may detonate on the Fourth of July. The rocket 100, which consists of a combustion chamber 106 and exhaust nozzles or grids 108, 110, carries liquid, solid, or plasma propellants that provide the fuel needed for propulsion and thus make the engine independent of the need for oxygen from the Earth's atmosphere, facilitating the rocket's use for space missions 104. If the rocket 100 is an electric rocket, it accelerates and expels charged particles through grids 108, 110 to thrust forward in the direction 112 while charged particles move in an opposite direction 114.

Plasma rockets are a type of electric rocket that uses a powerful electrical current to energize a gas within the combustion chamber 106 to turn it into a plasma. Plasma is a state of matter in which atoms have been ionized by electrical current. A collection of charged particles (including ions, free electrons, and neutral atoms with equal numbers of positive ions and electrons and exhibiting some properties of the former gas) is a good conductor of electricity and can be influenced by an electromagnetic field. A conventional type of plasma rocket uses a screen grid 108 that is proximally located to the combustion chamber 106. Distally located from the combustion chamber 106 is an accelerator grid 110. A strong electrical field is placed between the screen grid 108 and the accelerator grid 110, which acts to attract charged particles, such as ions, to the screen grid 108 and accelerates the charged particles out from the combustion chamber 106 through the accelerator grid 110 in the direction 114, hence propelling the rocket 100 toward the direction 112.

Grids 108, 110 are large plates that have numerous holes in them allowing charged particles to move through them. Typically, the screen grid 108 is made electrically positive (from one to several thousand volts) and the accelerator grid is made electrically negative (from one to several hundred volts). The potential difference between the two grids 108, 110 attracts and accelerates charged particles out and away from the combustion chamber 106. As the charged particles emerge, a small number of them may be attracted to the accelerator grid 110 and collide with the accelerator grid 110. In addition, some of the charged particles that exit the plasma rocket may experience a charge-exchange collision. These collisions result in charged particle being created with a low initial energy. This low energy initial condition inhibits newly created charged particles from having enough kinetic energy to overcome the potential gradients created by the accelerator grid 110 and a significant portion of these charged particles are accelerated toward the accelerator grid 110. These collisions between charged particles and the accelerator grid cause material to be ejected from the accelerator grid and are referred to as sputtering of the accelerator grid 110 and over time may cause significant deterioration of the accelerator grid 110.

Another problem that tends to deteriorate the accelerator grid 110 is arcing between the two grids. Depending upon the grid materials and the amount of energy stored in the arc, arcing can create a well or a pit in the accelerator grid, which gets deepened with repeated arcings until irreversible erosion results. An active area of research is to find a substance from which to build the accelerator grid 110 that could resist collisions with charged particles, hence enhancing the resistance to sputtering. The conventional substance that is used to make the accelerator grid 110 is molybdenum. Molybdenum is easily machinable to form the accelerator grid 110. One surprising material behavior of molybdenum is its resistance to arcing in that a well is unlikely to develop even with repeated arcing. The problem with molybdenum is its vulnerability to sputtering.

One attempt to provide a more sputtering-resistant substance has led to the use of carbon in the form of both graphite and carbon-carbon composite to supplant molybdenum for manufacturing the accelerator grid 110. The problem with these forms of graphite, however, is that the manufacturing process can result in minute fiber strands on the surface of the accelerator grid 110. Given that grids 108, 110 are separated by very small distance, these graphite fiber strands may cause multiple arcings to occur. Each arcing has an energy level associated with it. If the energy level is just enough to evaporate the graphite fiber strand, no further erosion of the accelerator grid 110 is likely to occur and the arcing will diminish with time. However, if there is too much energy in the arc, it will form a well or pit that deepens with repeated arcing. The arc deposits a great amount of energy upon the graphite fiber strand creating more fiber strands that over time will cause more arcing. This repeated arcing will either cause the spacecraft control system to turn the engine off for otherwise a hole is then formed. Either way the accelerator grid 110 will be destroyed completely.

The destructive power of arcing can be controlled by limiting the amount of energy presented to the grids 108, 110 by the power supply of the rocket 100. Conventional power supplies for rockets that use plasma propellants were designed for grids that are made out of molybdenum. Conventional power supplies have too much energy to actify grids 108, 110 made from graphite. The source of the energy that causes destructive arcings is a low-pass filter component in the output stage of a conventional power supply. The purpose of the low-pass filter component of the output stage is to smooth out the output DC voltage signal from the power supply. Such a voltage signal requires a large capacitor to implement the low-pass filter component for filtering substantial portions of the DC voltage signal. This large capacitor stores a great amount of energy that is unleashed with each arcing and destroys the accelerator grid 110 over time.

As a result of the desire to explore deeper expanses of space, rocket ships need rockets that can last twice as long as conventional rockets. One factor that has limited the useful life of conventional rockets is the erosion of the accelerator grids. The use of graphite as a substance to form the accelerator grid has overcome many of the problems associated with sputtering, but graphite is susceptible to arcings. Arcings act as a medium to transfer a great amount of destructive energy stored by conventional power supplies of conventional rockets and that in turn erodes the accelerator grid. Without a solution to enhance rocket power supplies to maintain the viability of accelerator grids, it may not be possible to have deep space missions to better understand our universe. Thus, there is a need for a method and a system for enhancing rocket power supplies while avoiding or reducing the foregoing and other problems discussed above.

SUMMARY OF THE INVENTION

In accordance with this invention, a system, method, and computer-readable medium for enhancing the propulsion of rockets is provided. The system form of the invention comprises a system for propelling a rocket. The system includes grids for attracting and accelerating charged particles. The system further includes a power supply that excludes an output filter. The power supply uses multiple phase input signals for generating an output DC voltage signal for creating an electrostatic field interposed between the grids for attracting and accelerating charged particles so as to propel the rocket.

In accordance with another aspect of the present invention, another system form of the invention comprises a system for providing power to grids of a rocket for propulsion. The system includes a power converter for converting multiple phase input signals into a DC output signal for powering the grids of the rocket. The system further includes a controller for generating multiple drive signals, the multiple drive signals being shifted in phase. The system further includes gate drivers for producing multiple phase input signals based on the multiple drive signals being shifted in phase.

In accordance with another aspect of the present invention, another system form of the invention comprises a circuit for powering a set of grids of an electric rocket. The circuit includes multiple phase inverter stages for generating multiple phase square wave signals. The circuit further includes a multiple phase resonant network for receiving the square wave signals with multiple phases for generating sinusoidal signals with multiple phases. The circuit as yet further includes multiple phase rectifier stages for receiving the sinusoidal signals with multiple phases and further for generating a DC voltage output signal to power the set of grids of the electric rocket.

In accordance with another aspect of the present invention, a method form of the invention comprises a method for generating power for rocket engines. The method includes generating multiple phase signals as input into a resonant network. The method further includes controlling power transfer via the frequency of the multiple phase signals. The method as yet further includes generating a DC signal used for powering rocket engines.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

As discussed hereinbefore, conventional power supplies that actify the grids of electric rockets use an output capacitor to smooth the output DC voltage signal. The output capacitor is typically large so that it can handle the voltage level of the output DC voltage signal (several thousand volts). Large capacitors tend to store great amounts of energy. Arcing acts to transfer this energy to create a well on an accelerator grid of electric rockets. This well may deepen over time with repeated arcings, hence eroding the accelerator grid. Various embodiments of the present invention eliminate or reduce the need to use an output capacitor. Various embodiments of the present invention use multiple phases of an input signal into the power supply to cause the output DC voltage signal to be substantially smooth.

Figure 1A:
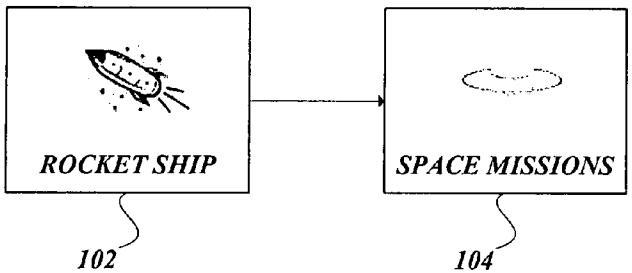
FIG. 1A is a block diagram illustrating conventional use of rocket ships for space missions.
Figure 1B:
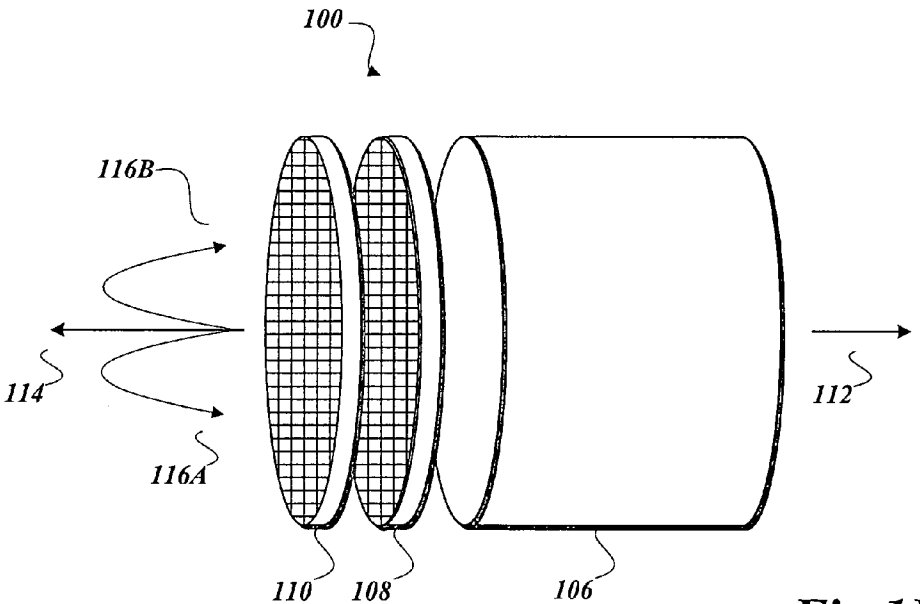
FIG. 1B is a pictorial diagram illustrating a conventional electric rocket using plasma to propel the rocket.
Figure 2A:
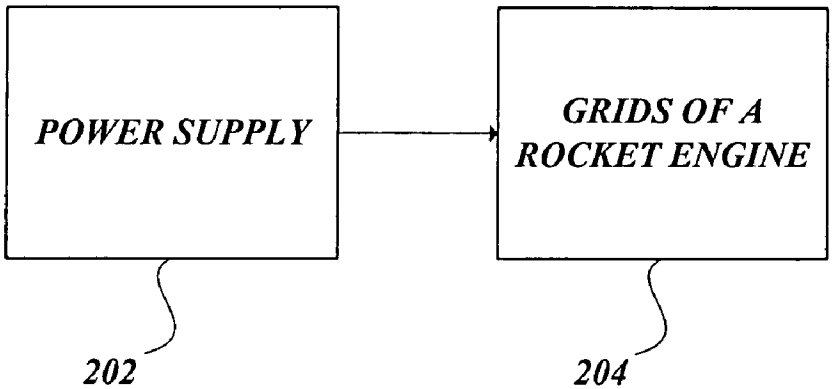
FIG. 2A is a block diagram illustrating an exemplary relationship between a power supply and the grids of a rocket engine.

A power supply 202, which is an electrical device that produces high DC voltage signals (for example, 5,000 volts), creates an electromagnetic field between grids of a rocket engine 204. See FIG. 2A. The grids attract and accelerate charged particles formed in a combustion chamber filled with plasma. For long duration missions, the grids are preferably formed from graphite to act as an accelerator grid and the other grid acts as a screen grid. The power supply 202 uses multiple phases of a sinusoidal signal to smooth the output DC voltage signal from the power supply 202, hence eliminating or reducing the need for output filtering via the use of an output capacitor. Various embodiments of the present invention inhibit destructive energy during arcing that reduces the life of the grids of the rocket engine 204 and allow deep space missions to be possible.

Figure 2B:
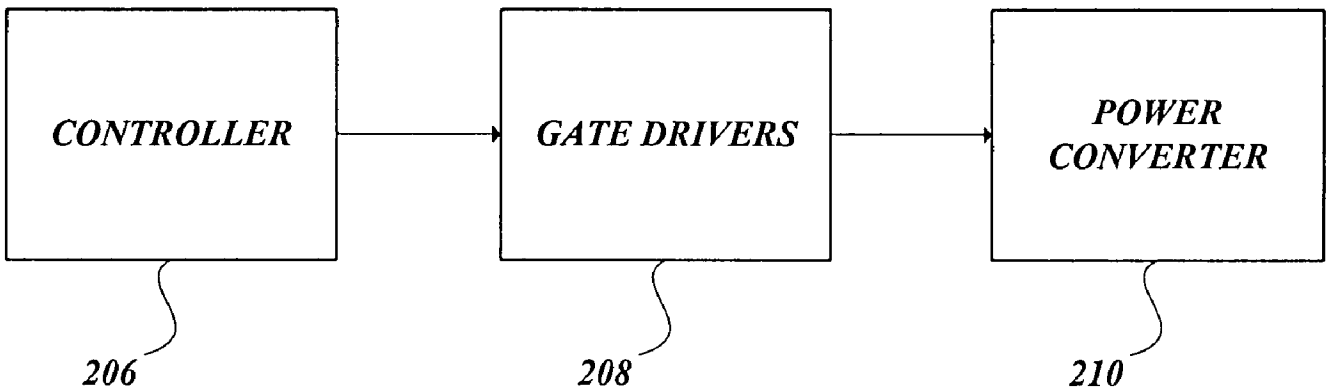
FIG. 2B is a block diagram illustrating an exemplary relationship between a controller, gate drivers, and a power converter of a power supply.

The power supply 202 is illustrated in greater detail in FIG. 2B. The power supply 202 includes a controller 206 that generates and provides drive signals to the gate drivers 208. The frequencies of the drive signals are modulated by the controller so as to control the amount of power that is transferred from the various stages of the power supply 202 leading to the output of the DC voltage signal. Preferably, the controller 206 modifies the phase of various drive signals presented to the gate drivers 208 so as to smooth the output DC voltage signal from the power supply 202 without the need to use an output filter, such as an output capacitor. The gate drivers 208 are driven by the controller 206 with a number of drive signals to activate the power converter 210.

Figure 2C:
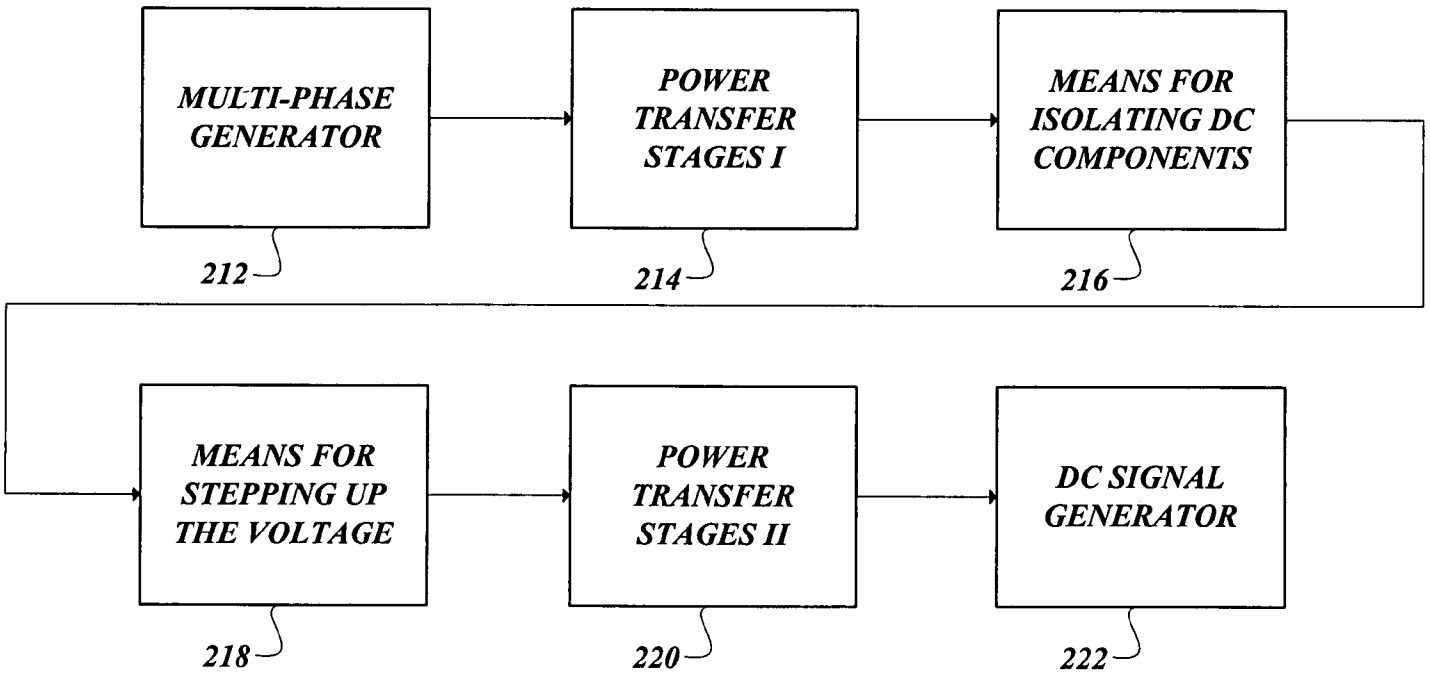
FIG. 2C is a block diagram illustrating exemplary relationships of a multiple phase generator, power transfer stages, means for isolating DC components, means for regulating the impedance of the load, and a DC signal generator.

FIG. 2C illustrates the power converter 210 in greater detail. A multi-phase generator 212 creates multiple square waves that have different phases. Multiple square waves with multiple phases are presented to a power transfer stage I 214. The frequency of the square waves governs the amount of power that is transferred by the power transfer stage I 214. One suitable implementation of the power transfer stage I is a resonant circuit, such as a series resonant circuit. Unless the frequency of the square waves is about the resonant frequency of the power transfer stage I 214, not all of the energy of the square waves will be transferred to subsequent stages of the power converter 210. The power transfer stage I 214 transforms the square waves into sinusoidal signals with DC components.

These sinusoidal signals are presented to a means for isolating DC components 216, which jettisons the DC components of the sinusoidal signals. A means for stepping up the voltage 218 is provided by the power converter 210 to step up the voltage of the sinusoidal signals from approximately 160 volts to several thousand volts, which can create an electrostatic field of sufficient energy to accelerate charged particles from the plasma propellants of the rocket engine. Preferably, a ferromagnetic core transformer can be used to act as the means for isolating DC components of the signals and as the means for stepping up the voltage.

A power transfer stage II 220 is another circuit of the power converter 210 for controlling the amount of energy that is transferred from previous stages to a DC signal generator 222. Preferably, the power transfer stage II 220 is a resonant circuit. One suitable resonant circuit includes a parallel resonant circuit. If the frequency of the signals coming from the means for stepping up the voltage 218 is the resonant frequency of the power transfer stage II 220, all of the energy will be transferred. Otherwise, only a portion of the energy is transferred by the power transfer stage II 220. The DC signal generator receives sinusoidal signals with multiple phases from the power transfer stage II 220 and generates a DC voltage signal to actify the grids of the rocket engine 204.

Figure 3:
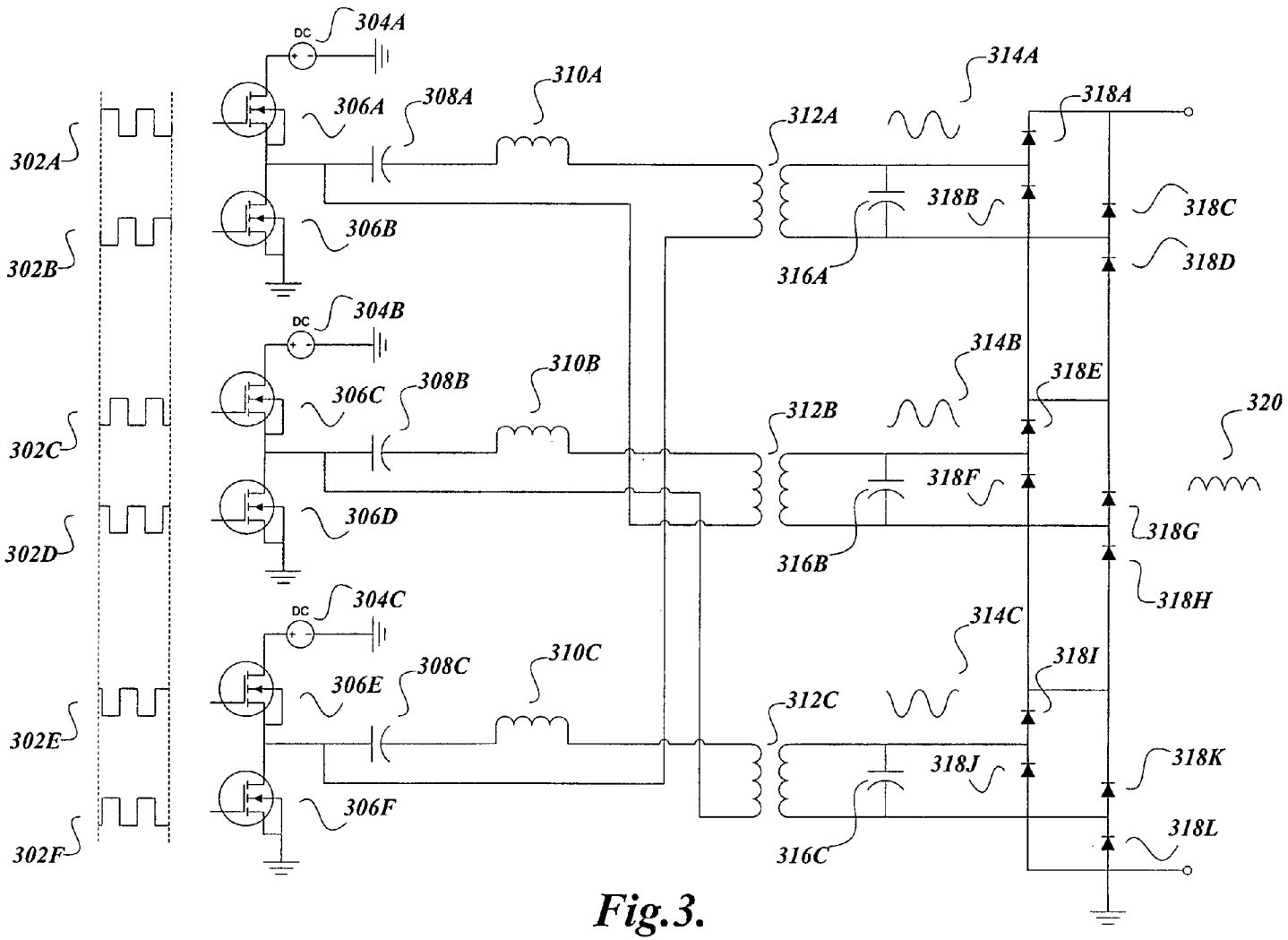
FIG. 3 is a circuit diagram of a power supply in accordance with one embodiment of the present invention.
Figure 4A:
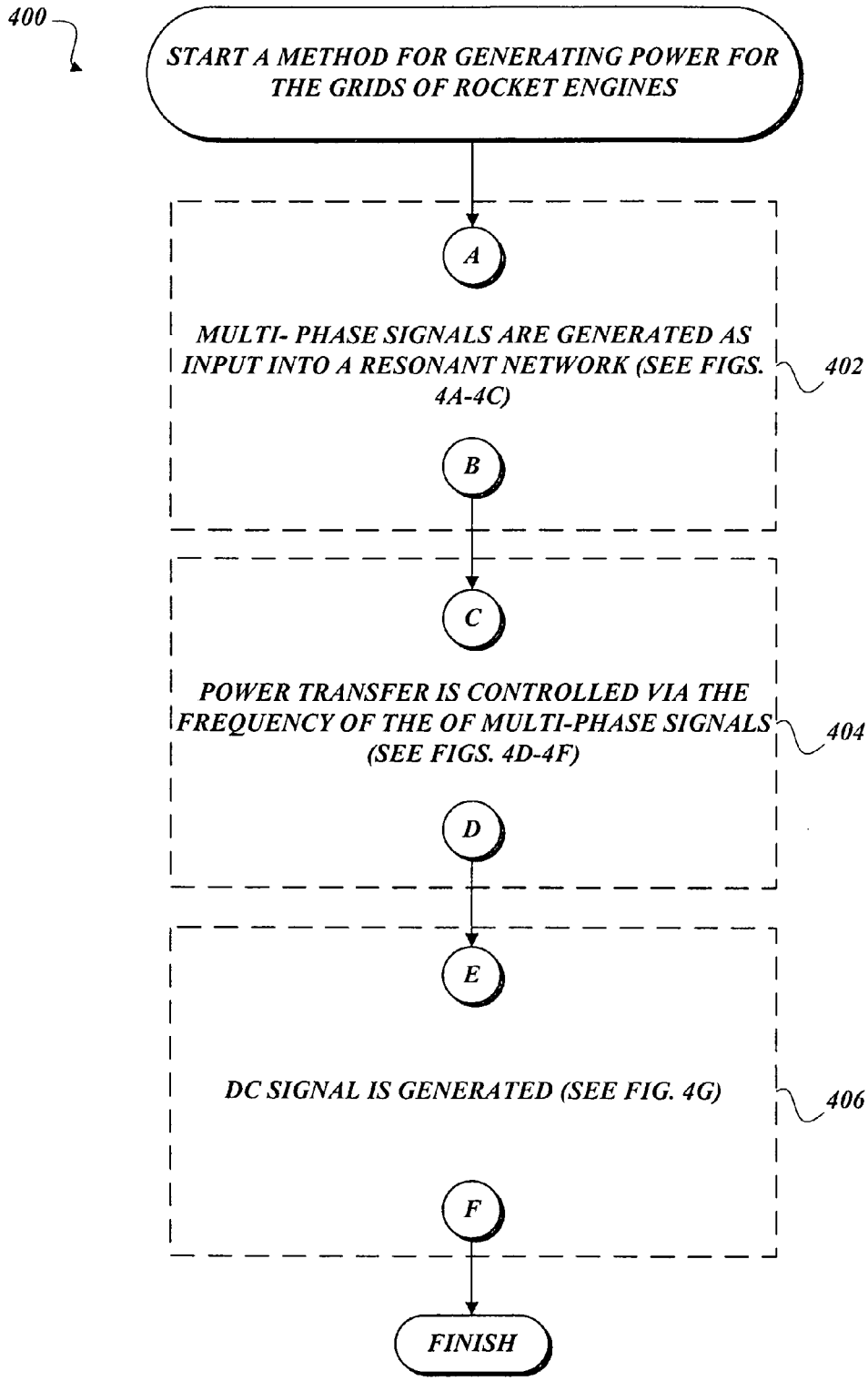
FIGS. 4A-4G are process diagrams illustrating a method for generating power for rocket engines.
Figure 4B:
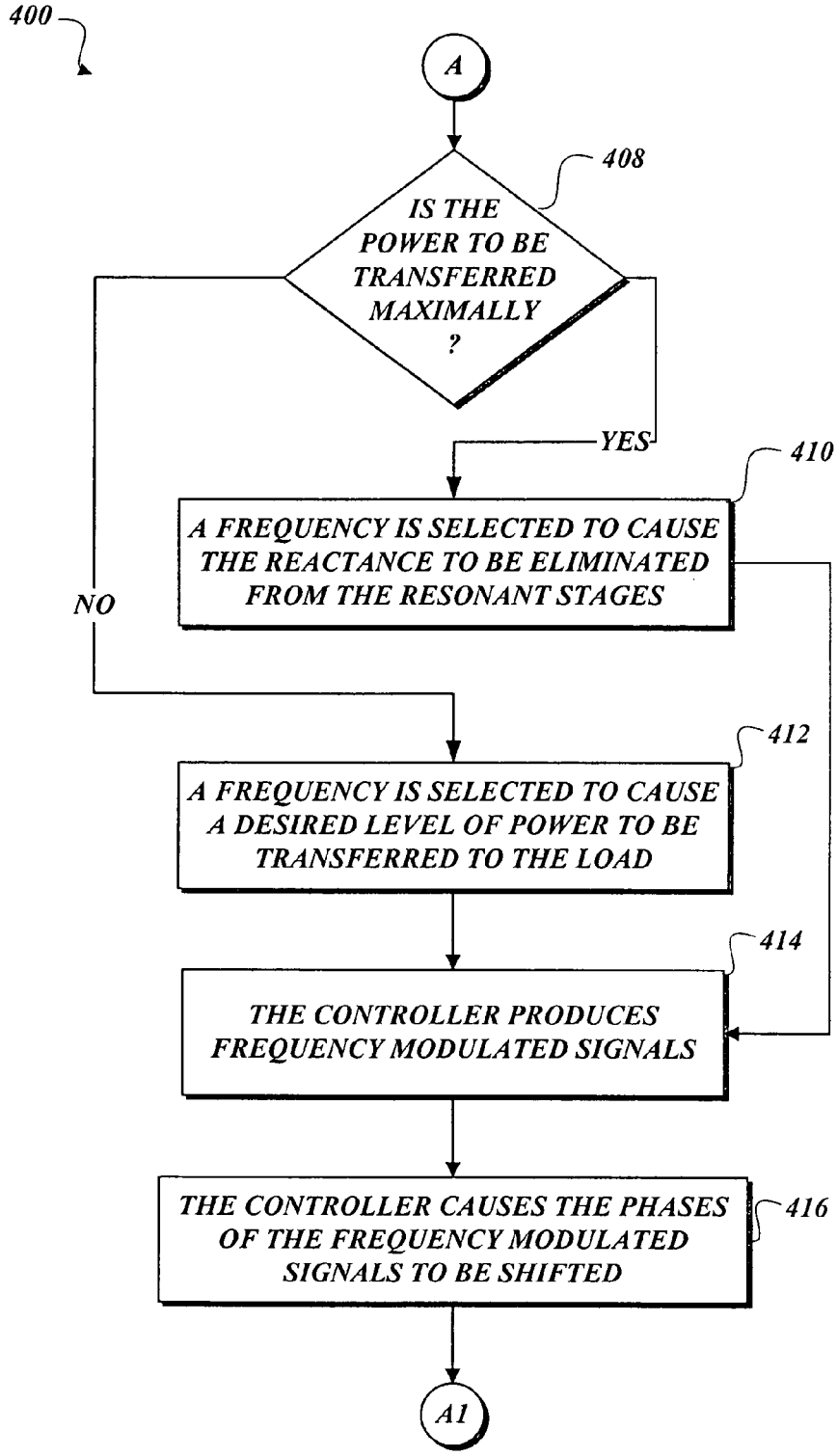
Figure 4C:
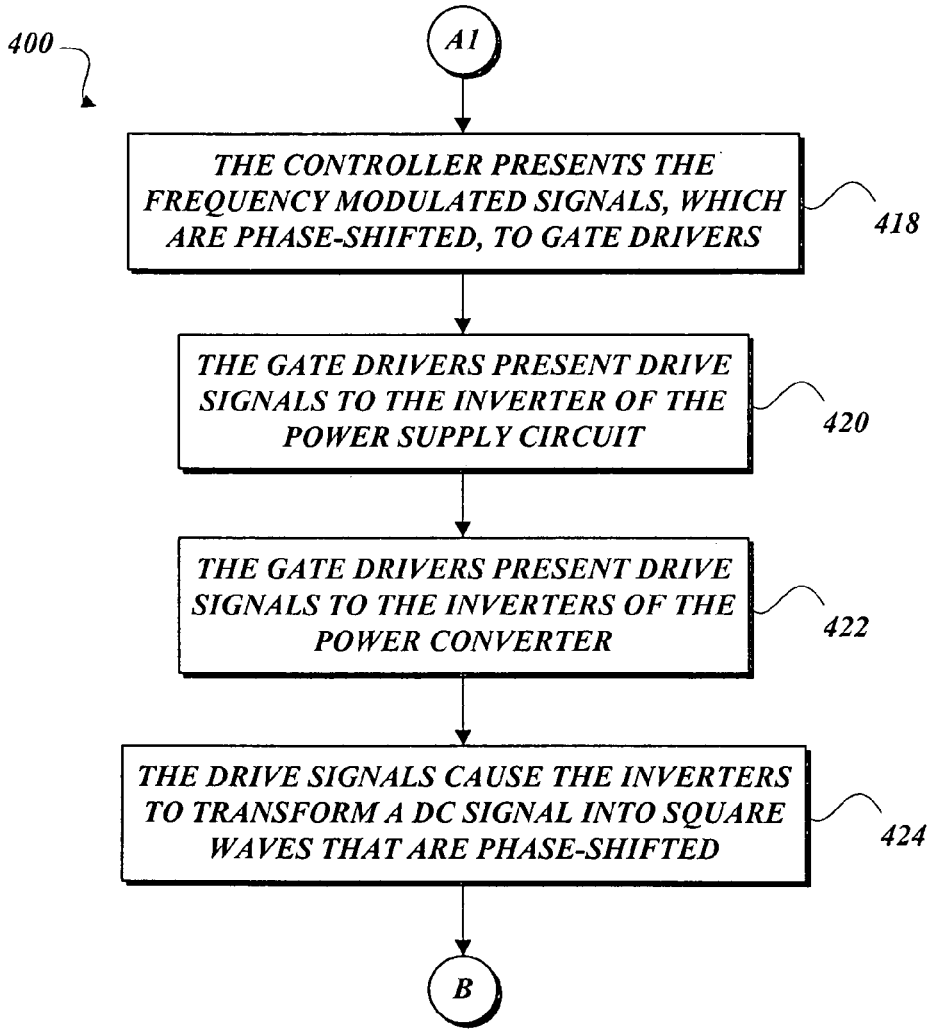
Figure 4D:
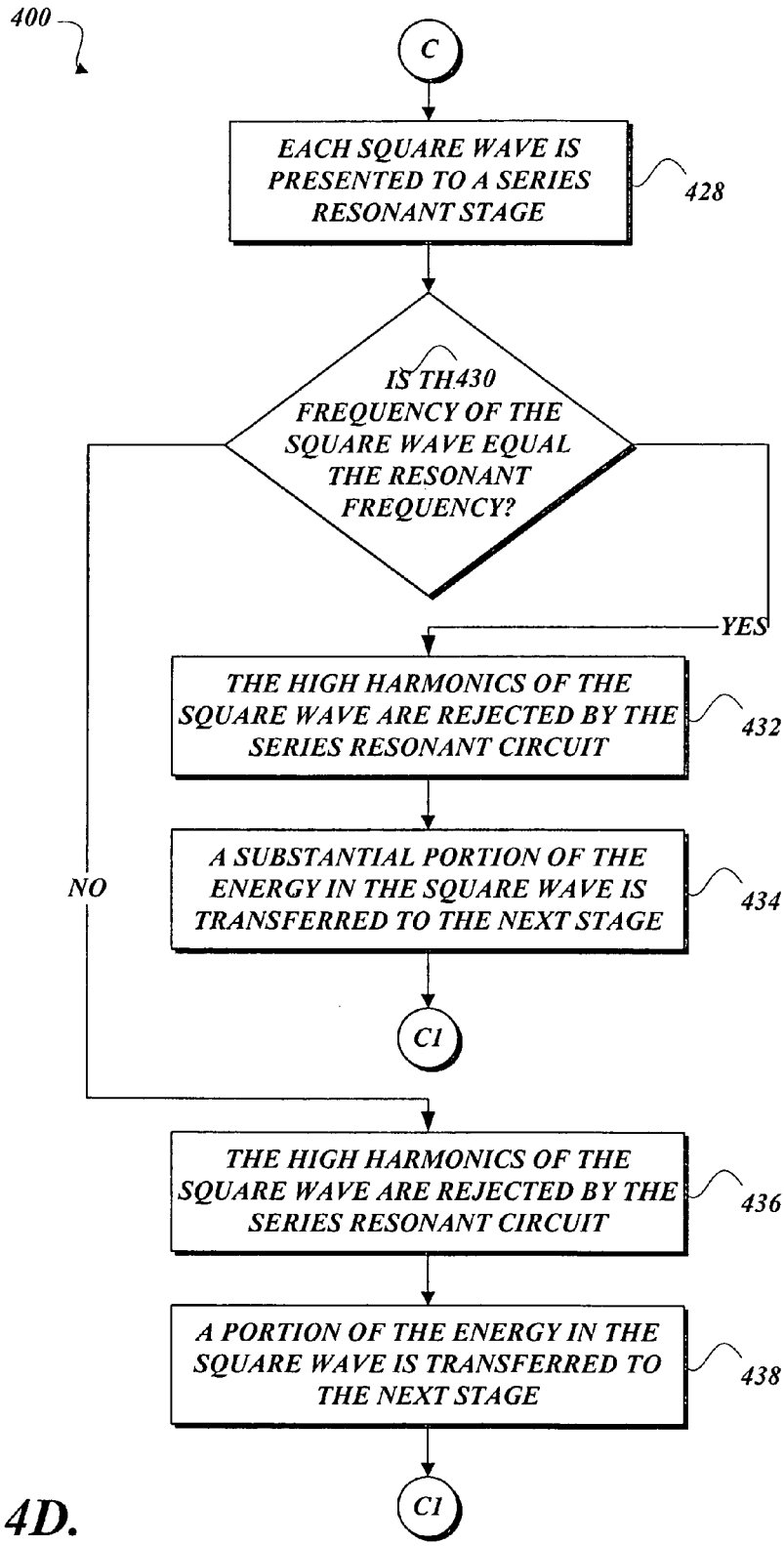
Figure 4E:
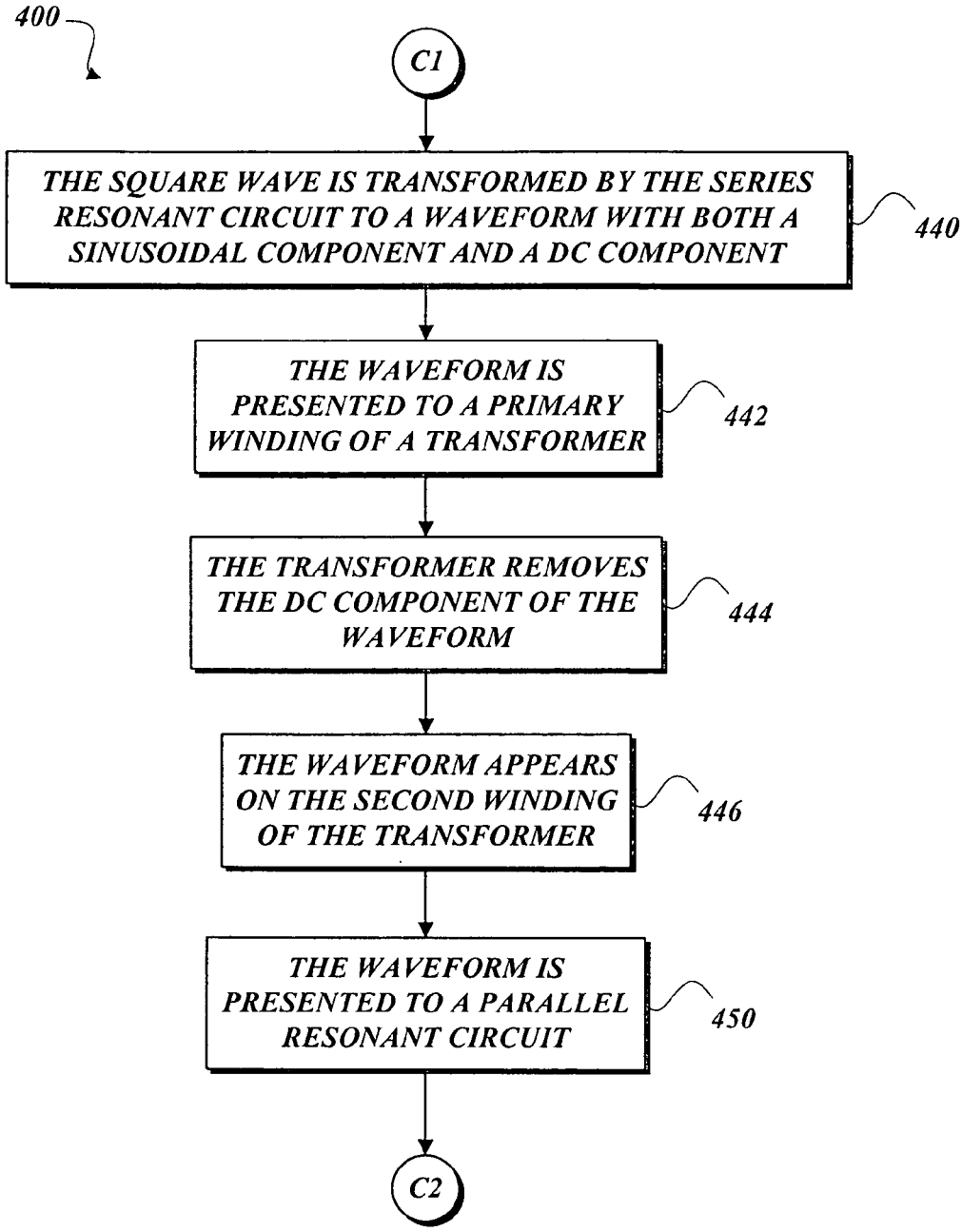
Figure 4F:
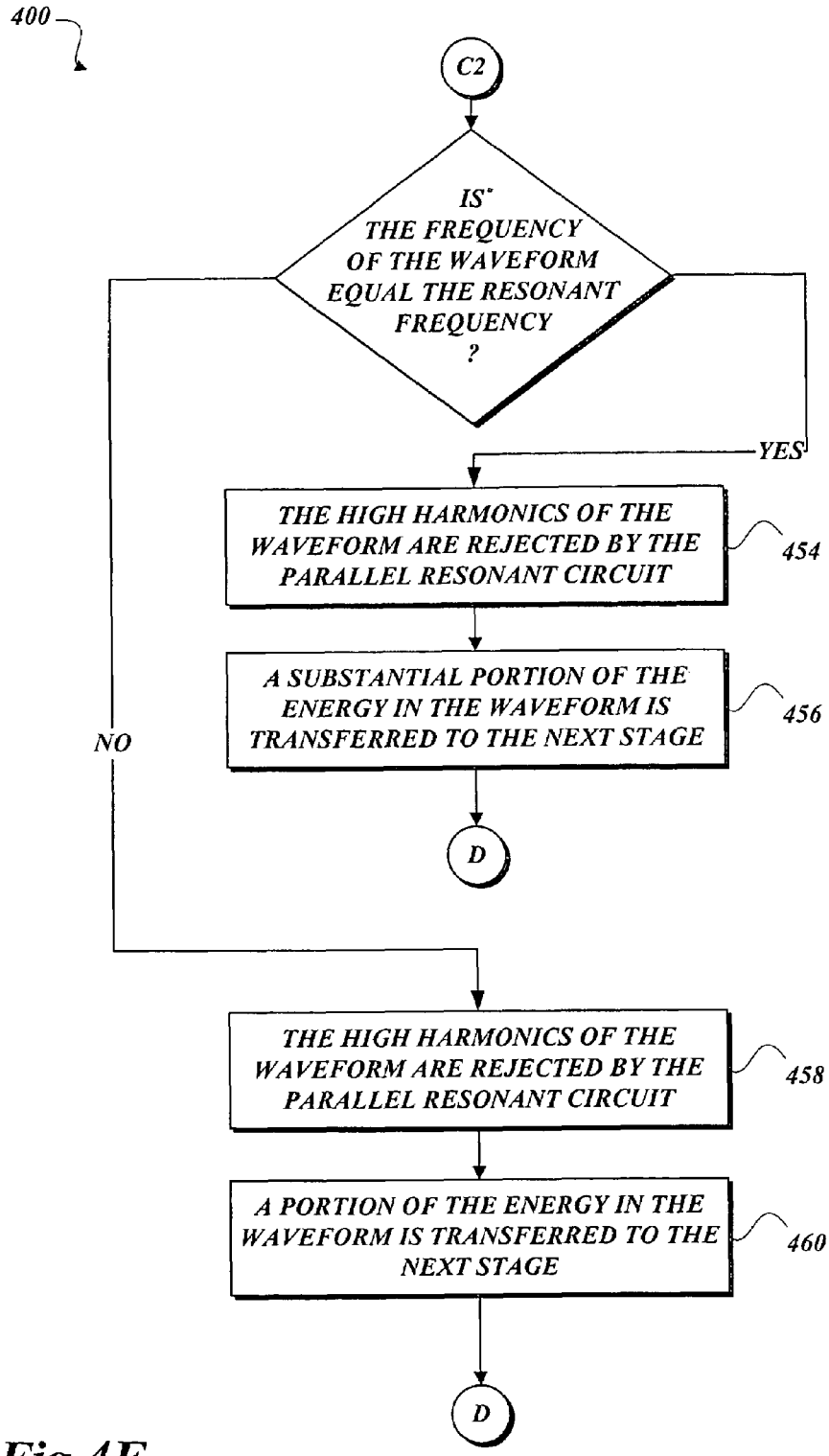
Figure 4G:
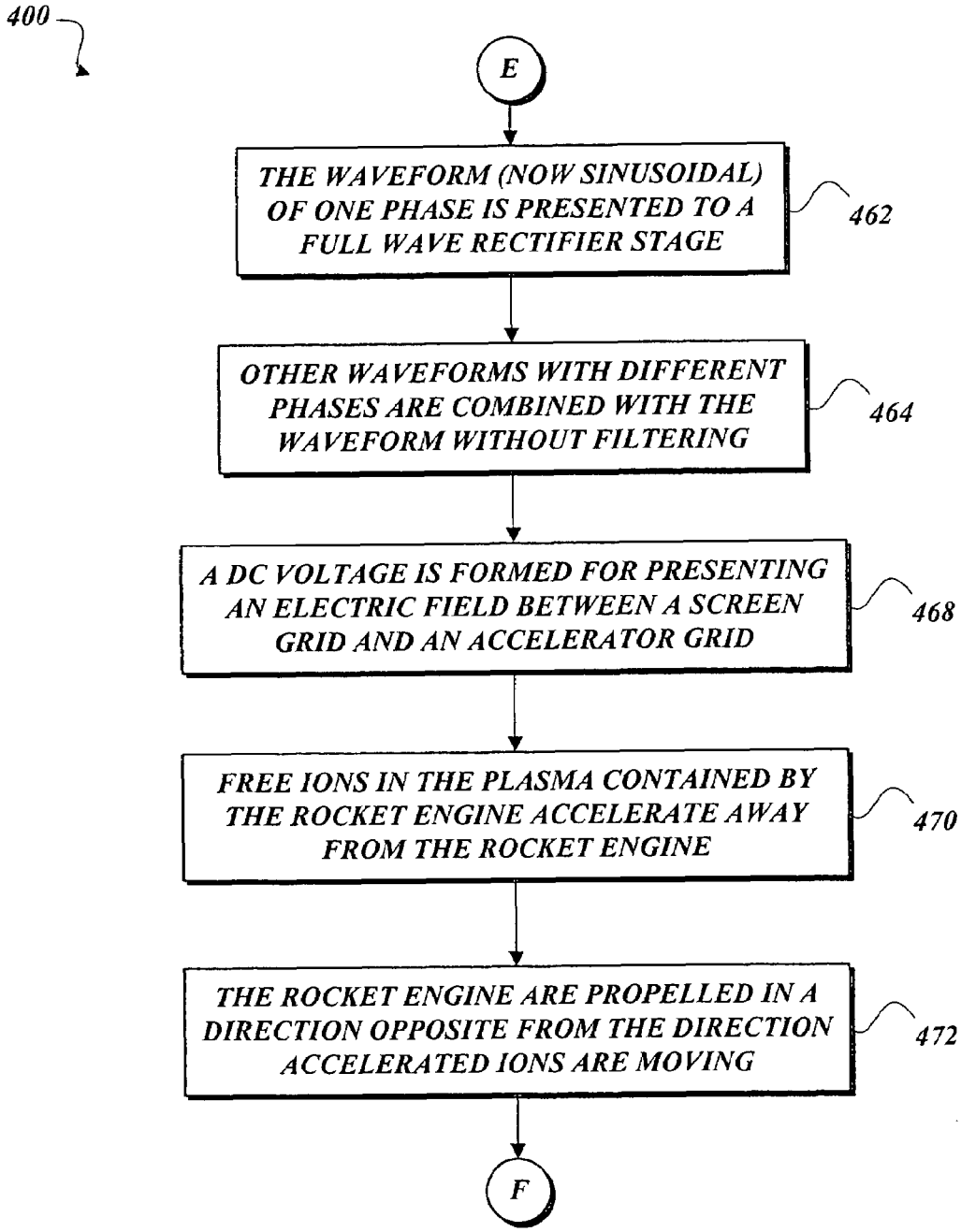

FIG. 3 illustrates a circuit diagram for a power converter 210. Multiple frequency modulated signals 302A-302F with multiple phases are introduced to power transistors 306A-306F. Any suitable power transistor can be used. One suitable power transistor includes an NMOS transistor in which the substrate is electrically coupled to the source. A transistor pair 306A, 306B is arranged in a totem pole configuration in which the source of the power transistor 306A is coupled to the drain of the power transistor 306B. The transistor pair 306A, 306B forms an inverter. The drain of the power transistor 306A is coupled to a DC voltage source 304A (approximately 160 volts). The source of the power transistor 306B is coupled to ground. The gate of the power transistor 306A is capable of receiving a drive signal 302A, which can be frequency modulated. The gate of the power transistor 306B is capable of receiving a drive signal 302B which is complementary to the drive signal 302A such that when the power transistor 306A is turned on, the power transistor 306B is turned off, and vice versa.

Another power transistor pair 306C, 306D is also configured in a totem pole arrangement in which the source of the power transistor 306E is coupled to the drain of the power transistor 306D. The drain of the power transistor 306C is electrically coupled to a DC voltage source 304B (approximately 160 volts) and the source of the power transistor 306D is electrically coupled to ground. The gates of the power transistor 306C, 306D are capable of receiving drive signals 302C, 302D, respectively. Drive signal 302C is a complement of the drive signal 302D so as to suitably turn on and off the power transistors 306C, 306D to function as an inverter. Drive signals 302C, 302D are made to be out of phase with drive signals 302A, 302B.

Power transistor 306E together with power transistor 306F, forms an inverter in a totem pole configuration. A DC voltage source 304C (approximately 160 volts) is electrically coupled to the drain of the power transistor 306E. The source of the power transistor 306E is coupled to the drain of the power transistor 306F. The source of the power transistor 306F is coupled to ground. Preferably, DC voltage sources 304A-304C are the same voltage source. The gate of the power transistor 306E is capable of receiving a drive signal 302E, which can be frequency modulated. The gate of the power transistor 306F is also capable of receiving a drive signal 302F, which can also be frequency modulated. Drive signals 302E, 302F are preferably out of phase with drive signals 302C, 302D and drive signals 302A, 302B. More than three inverters can be suitably used when there are more than three phases being used by the power supply 202 to smooth the output DC voltage signal. However, two phases can also be used if the ripple of the output DC voltage signal is acceptable. The collection of inverters can be generally referred to as a multiple phase inverter stage and if there are three inverters, the collection can be specifically called a three-phase inverter.

The inverter formed from the pair of power transistors 306A, 306B is electrically coupled to a power transfer stage I, which comprises a capacitor 308A and an inductor 310A. The capacitor 308A is preferably formed from a 23 nanoFarad device in series with the inverter formed from the power transistors 306A, 306B and additionally in series with the inductor 310A. The inductor 310A is preferably formed from a 103 microHenry device. The capacitor 308A and the inductor 310A together operate as a series resonant circuit to produce a sinusoidal signal that still has some DC components of the square wave signal produced by the inverter 306A, 306B. The energy in the sinusoidal signal is a portion of the energy in the square wave signal presented to the series resonant circuit formed by the capacitor 308A and the inductor 310A unless the frequency of the square wave signal is the same as the resonant frequency of the resonant circuit.

A similar power transfer stage I comprises a capacitor 308B, which is preferably 23 nanoFarad, and an inductor 310B, which is preferably 103 microHenry. The power transfer stage I formed form the capacitor 308B and the inductor 310B is suitably a series resonant circuit. A sinusoidal signal is produced with DC components by the series resonant circuit formed by the capacitor 308B and the inductor 310B from a square wave created by the inverter formed from the transistors 306C, 306D. Not all of the energy in the square wave from the inverter 306C, 306D is transferred to the sinusoidal signal formed from the series resonant circuit unless the frequency of the square wave is the same as the resonant frequency of the series resonant circuit formed from the capacitor 308B and the inductor 310B.

Another power transfer stage I is formed from a series resonant circuit configuration of a capacitor 308C and an inductor 310C. Preferably, the capacitor 308C is formed from a 23 nanoFarad device and the inductor 310C is formed from a 10 microHenry device. A square wave signal is generated from the inverter formed from the power transistors 306E, 306F. Not all of the energy of the square wave is transferred to a sinusoidal signal with DC components formed from the series resonant circuit of the capacitor 308C and the inductor 310C unless the frequency of the square wave signal is the same as the resonant frequency of the series resonant circuit. Note that the phase of each square wave (formed from the power transistor pairs 306A, 306B; 306C, 306D; and 306E, 306F) is different from each other. Hence, the sinusoidal signals with DC components coming from the various series resonant circuits are also out of phase with respect to one another. For the sake of simplicity, three power transfer stages I are shown but more or fewer stages can be used. When three power transfer stages I are used, these stages can be specifically called a three-phase series resonant circuit or can be generally called multiple phase series resonant stages.

Transformers 312A-312C are electrically coupled to the series resonant circuits formed from the capacitor 308A, the inductor 310A; the capacitor 308B, the inductor 310B; and the capacitor 308C, the inductor 310C, respectively. The transformers 312A-312C eliminate the DC components of the sinusoidal signals from entering the primary windings of the transformers 312A-312C. The transformers 312A-312C additionally step up the voltage to a desired level for actifying the grids of the rocket engine. More than three transformers can be used when more than three phases are used to smooth the output DC voltage signal coming from the power supply 202. A power transfer stage II 220 is formed from an inductor associated with the secondary winding of the transformer 312A and a capacitor 316A arranged in a parallel configuration. Another power transfer stage II 220 is formed from an inductor associated with the secondary winding of the transformer 312B and a capacitor 316B arranged in a parallel configuration. A further power transfer stage II 220 is formed from an inductor associated with the secondary winding of the transformer 312C and a capacitor 316C arranged in a parallel configuration. Capacitors 316A-316C are each preferably 110 picofarad.

These power transfer stages II 220 form parallel resonant circuits that further limit the amount of energy transfer from the sinusoidal signals produced by transformers 312A-312C to the sinusoidal signals produced by the parallel resonant circuits unless the frequency of the sinusoidal signals produced by the transformers 312A-312C is the same as the resonant frequency of the parallel resonant circuits. For the sake of simplicity, three power transfer stages II are shown but more or fewer stages can be used. When three power transfer stages II are used, these stages can be specifically called a three-phase parallel resonant circuit or can be generally called multiple phase parallel resonant stages. The multiple phase series resonant stages, the transformers, and the multiple phase parallel resonant stages can be collectively called a resonant network. Exemplary sinusoidal signals 314A-314C illustrate that these three signals are out of phase with respect to one another coming out from the various parallel resonant circuits.

Three full wave rectifier stages are formed from diodes 318A-318D. For the sake of simplicity, three full wave rectifier stages are shown but more or fewer stages can be used. When three full wave rectifier stages are used, these stages can be specifically called a three-phase rectifier or can be generally called multiple phase rectifier stages. The anode of the diode 318A is electrically coupled to the anode of the diode 318C. The output of the power converter 210 is taken with respect to the anodes of the diodes 318A, 318C. The cathode of the diode 318A is electrically coupled to the capacitor 316A and the anode of the diode 318B. The cathode of the diode 318C is electrically coupled to the capacitor 316A and the anode of the diode 318D. Another full wave rectifier stage is formed from diodes 318E-318H. The cathodes of the diodes 318B, 318D are electrically coupled to the anodes of the diodes 318E, 318G. The cathode of the diode 318E is electrically coupled to the capacitor 316B and the anode of the diode 318F. The cathode of the diode 318G is electrically coupled to the capacitor 316B and the anode of the diode 318H. Another full wave rectifier stage is formed from the diodes 3181-318L. The cathodes of the diodes 318F, 318H are electrically coupled to the anodes of the diodes 3181, 318K. The cathode of the diode 318I is electrically coupled to the capacitor 316C and the anode of the diode 318J. The cathode of the diode 318K is electrically coupled to the capacitor 318C and the anode of the diode 318L. The cathode of the diode 318J is electrically coupled to the cathode of the diode 318L and is further coupled to ground. The output of the power converter 210 is taken from the anode of the diode 318C and the cathode of the diode 318L. The output DC signal 320 is shown as being a substantially smooth signal that is composed of multiple sinusoidal signals with multiple phases.

FIGS. 4A-4G illustrate a method 400 for generating power for the grids of rocket engines. From a start block, the method 400 proceeds to a set of method steps 402, defined between a continuation terminal ("terminal A") and an exit terminal ("terminal B"). The set of method steps 402 describes the generation of multi-phase signals as input into a resonant network. The resonant network is formed from capacitors 308A-308C, 316B-316C; inductors 310A-310C; and the second winding of transformers 312A-312C.

From terminal A (FIG. 4B), the method 400 proceeds to decision block 408 where a test is made to determine whether the power is to be transferred maximally from the input to the output of the power converters 210. If the answer to the test at decision block 408 is YES, a frequency is selected to cause the reactants of the resonant stages to be eliminated. See block 410. If the answer to the test at decision block 408 is NO, a frequency is selected to cause a desired level of power to be transferred to the next stage. See block 412. From both blocks 410, 412 the method 400 proceeds to block 414 where the controller 206 produces frequency modulated drive signals. The frequency by which the drive signals are modulated is the selected frequency for allowing power to maximally transfer or for only a portion to transfer. The controller 206 causes the phases of the frequency modulated drive signals to be shifted. See block 416. These phase shifted drive signals reduce or eliminate the need to use an output filter by the power converter 210. With the absence of the output filter, undesirable high energy is inhibited from causing arcings that erode the grids of a rocket engine. Moreover, the elimination of the output filter is likely to reduce the weight of the rocket engine, hence facilitating more efficient travel for deep space missions. The method 400 then proceeds to another continuation terminal ("terminal A1").

From terminal A1 (FIG. 4C), the method 400 proceeds to block 418 where the controller 206 presents the frequency modulated drive signals, which have been phase shifted, to gate drivers 208. The gate drivers isolate the high voltages associated with the power converter 210 from the more limited voltages used by the controller 206. The gate drivers 208 present drive signals to the inverters of the power converter 210. The inverters are formed from the power transistors 306A-306F configured in a totem pole arrangement. See block 422. At block 424, the drive signals cause the inverters to transform a DC voltage signal obtained from voltage sources 304A-304C into square waves that are also phase shifted.

From terminal B, the method 400 proceeds to a set of method steps 404, defined between a continuation terminal ("terminal C") and an exit terminal ("terminal D"). The set of method steps 404 describes the control of the power transfer via the frequency of the multi-phase drive signals.

From terminal C (FIG. 4D), the method 400 proceeds to block 428 where each square wave is presented to a series resonant stages formed by a pair of the capacitor 308A and the inductor 310A; the capacitor 308B and the inductor 310B; and the capacitor 308C and the inductor 310C. The method 400 then proceeds to decision block 430 where a test is made to determine whether the frequency of the square wave equals the resonant frequency of the series resonant stage. If the answer to the test at decision block 430 is YES, the high harmonics of the square wave are rejected by the series resonant circuit. See block 432. A substantial portion of the energy in the square wave is transferred to the next stage in the power converter 210. See block 434. If the answer to the test at decision block 430 is NO, the high harmonics of the square wave are rejected by the series resonant circuit. See block 436. A portion of the energy in the square wave is transferred to the next stage in the power converter 210. See block 438. The method 400 from both blocks 434, 438 proceeds to another continuation terminal ("terminal C1").

From terminal C1 (FIG. 4E), the square wave is transformed by the series resonant circuit to a waveform with both a sinusoidal component and a DC component. See block 440. The waveform is presented to a primary winding of a transformer, such as transformers 312A-312C. See block 442. The transformer removes the DC component of the waveform. See block 444. The waveform appears on the second winding of the transformer and steps up its voltage level (from approximately 160 volts to several thousand volts). See block 446. The method 400 then proceeds to block 450 where the waveform is presented to one or more parallel resonant circuits. The parallel resonant circuits are formed from the second winding of transformers 312A-312C and capacitors 316A-316C. The method 400 then proceeds to another continuation terminal ("terminal C2").

From terminal C2 (FIG. 4F), the method 400 proceeds to decision block 452 where a test is made to determine whether the frequency of the waveform is equal to the resonant frequency of the parallel resonant circuit. If the answer to the test at decision block 452 is YES, the high harmonics of the waveform are rejected by the parallel resonant circuit. See block 454. A substantial portion of the energy in the waveform is transferred to the next stage, which is the rectifier stage. See block 456. The method 400 then proceeds to terminal D. If the answer to the test at decision block 452 is NO, the high harmonics of the waveform are rejected by the parallel resonant circuit. See block 458. A portion of the energy in the waveform is then transferred to the next stage. See block 460. The method 400 then proceeds to terminal D.

From terminal D (FIG. 4A), a DC signal is generated at several thousand volts for creating an electrostatic field between the screen grid and the accelerator grid of a rocket engine. The generation of the DC voltage signal is described by a set of method steps 406, defined between a continuation terminal ("terminal E") and an exit terminal ("terminal F").

From terminal E (FIG. 4G), a waveform (now substantially in sinusoidal form) of one phase is presented to a full wave rectifier stage. See block 462. Multiple full wave rectifier stages are available, such as the stage formed from diodes 316A-316D; another stage formed from diodes 316E-316H; and yet another stage formed from diodes 316I-316L. Other waveforms with different phases are combined with the waveform without filtering. See block 464. One reason why this is possible is that multiple phases are being combined by the full wave rectifier stages to limit the amount of ripple in the output DC signal. The DC voltage signal is formed for presenting an electric field between a screen grid and an accelerator grid of a rocket engine. See block 468. Free ions in the plasma contained in the rocket engine accelerate away from the rocket engine under the influence of the electric field between the screen grid and the accelerator grid. See block 470. The rocket engine is propelled in the direction opposite from the direction in which accelerated ions are moving under Newtonian laws. See block 472. The method 400 then continues to terminal F where the method terminates execution.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A circuit for powering a set of grids of an electric rocket, comprising:

multiple phase inverter stages for generating multiple phase square wave signals;

a multiple phase resonant network for receiving the square wave signals with multiple phases for generating sinusoidal signals with multiple phases; and multiple phase rectifier stages for receiving the sinusoidal signals with multiple phases and further for generating a DC voltage output signal to power the set of grids of the electric rocket, the set of grids providing particle acceleration and a propulsive force for the rocket.

2. The circuit of claim 1, wherein the multiple phase inverter stages include sets of inverters formed from power transistors configured in a totem pole arrangement.

3. The circuit of claim 1, wherein the multiple phase resonant network includes sets of series resonant circuits for limiting transferred power.

4. The circuit of claim 1, wherein the multiple phase resonant network includes transformers for isolating DC components and stepping up the voltage.

5. The circuit of claim 1, wherein the multiple phase resonant network includes sets of parallel resonant circuits for limiting transferred power.

* * * * *

UNITED STATES PATENT AND TRADEMARK OFFICE

CERTIFICATE OF CORRECTION

PATENT NO. : 7,631,482 B2
APPLICATION NO. : 11/123374
DATED : December 15, 2009
INVENTOR(S) : Drummond et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1255 days.

Signed and Sealed this

Second Day of November, 2010

David J. Kappos

David J. Kappos
*Director of the United States Patent and Trademark Office*